US005209449A

United States Patent [19]

Hart

[11] Patent Number: 5,209,449

[45] Date of Patent: May 11, 1993

[54] APPARATUSES AND METHODS FOR HANGING FRAMES

[76] Inventor: Hoyt E. Hart, 4900-C Jefferson, NE., Albuquerque, N. Mex. 87109

[21] Appl. No.: 822,061

[22] Filed: Jan. 14, 1992

[51] Int. Cl.[5] ..... A47F 7/14

[52] U.S. Cl. ..... 248/475.1; 248/542; 248/544

[58] Field of Search ..... 248/544, 475.1, 466, 248/489, 495, 542, 547; 40/152.1; D10/62

[56] References Cited

U.S. PATENT DOCUMENTS

| | | | |
|---|---|---|---|
| D. 282,054 | 1/1986 | Hoffman | D10/62 |
| 3,552,708 | 1/1971 | Hillstrom | 40/152.1 X |
| 3,955,790 | 5/1976 | Ballin | 248/489 |
| 4,220,309 | 9/1980 | Eisen | 248/542 |
| 4,228,982 | 10/1980 | Sellers | 248/467 |
| 4,437,639 | 3/1984 | Stein | 248/489 X |
| 4,458,873 | 7/1984 | Sutherland | 40/152.1 X |
| 4,530,482 | 7/1985 | Berinson | 248/475.1 |
| 4,531,315 | 7/1985 | Sobel | 40/152.1 X |
| 4,582,288 | 4/1986 | Ruehl | 248/547 |
| 4,597,554 | 7/1986 | James | 248/542 |
| 4,606,526 | 8/1986 | Rabinowitz | 248/489 |
| 4,712,761 | 12/1987 | Wassell | 40/152.1 X |
| 4,804,161 | 2/1989 | Wallo | 248/544 |
| 5,080,317 | 1/1992 | Letizia | 248/466 X |

OTHER PUBLICATIONS

Advertisement, WallBuddies TM, Picture Perfect, Sioux Falls, S. Dak., *Picture Framing Magazine*, p. 43, (Jun. 1991).

Advertisement, PicTabs TM, LorLor TM, LorLor Corporation, Morton Grove, Ill., *Picture Framing Magazine*, p. 79, (Sep. 1991).

Advertisement, H-Hanger, Lion, Birmingham, England, *Decor Services* (Annual), p. 498, (1991-1992).

Advertisement, De Luxe "Floreat" Hangers, Ziabicki Import Company, Racine, Wis., *Picture Framing Magazine*, p. 100, (Sep. 1991).

Advertisement, Record Art Gallery Rods, S&W Framing Supplies, Inc., Garden City Park, N.Y., *Decor*, p. 180, (Nov. 1991).

Advertisement, Arakawa Hanging Systems International, Portland, Oreg., *Picture Framing Magazine*, p. 8, (Nov. 1991).

Advertisement, Starlight Industries Inc., Brooklyn, N.Y. 11201, *Picture Framing Magazine*, p. 65, (Jul. 1991).

*Primary Examiner*—J. Franklin Foss

*Attorney, Agent, or Firm*—Deborah A. Peacock; Donovan F. Duggan; Rod D. Baker

[57] ABSTRACT

The invention concerns apparatuses and methods for hanging frames upon mounting surfaces. The apparatus of the invention, upon which a frame is hung, is securely attached to a mounting surface, such as a wall. The apparatus comprises a generally planar body with protruding supporting rail, alignment notches, spirit level, bracket recess, and mounting holes. The apparatus is particularly well suited for use with metal frames with universal assembly channels. The supporting rail of the apparatus is designed to be inserted within universal assembly channels in metal frames, thus securely yet slidably and removably attaching the apparatus to the frame.

18 Claims, 2 Drawing Sheets

APPARATUSES AND METHODS FOR HANGING FRAMES

BACKGROUND OF THE INVENTION

1. Field of the Invention (Technical Field)

The invention relates to apparatuses for hanging frames upon surfaces, and methods for their use.

2. Background Art

Despite some variety of efforts to overcome the problem, there remains a need for an improved means for hanging framed works, one that assures that the work will hang securely in a level position. The present invention fills the need by providing a simple, inexpensive, and easy-to-use apparatus and method that permit the user quickly and securely to hang a frame upon a wall or other vertical surface. Practicing the present invention, the user can consistently hang a frame on the level, with the top and bottom edges of the frame in a pleasantly horizontal aspect.

British Patent No. 1,031,208 to Chan discloses a picture-hanging apparatus comprising a supporting member to be attached to a wall and a second separate member, to be attached to the back of a picture frame, for engagement with the supporting member. The invention disclosed in the '208 Patent requires that a particular customized element be attached to the frame to be hung.

U.S. Pat. No. 4,228,982 to Sellera discloses an apparatus similar to the apparatus of the above-mentioned British patent to Chan. The '982 patent discloses an apparatus composed of two separate elements: one element to be attached to a wall, and the other specially adapted companionate element necessarily attached to the frame to hung.

U.S. Pat. No. 4,530,482 to Berinson discloses an apparatus for hanging framed pictures consisting of a lengthy resinous strip to be attached to the wall and picture mounts with sharp edges to be attached to picture frames. The sharp edges of the picture mounts are then inserted between the strip and wall to hang picture frames. The apparatus necessarily includes a specially adapted element to be attached to the frame to be hung.

U.S. Pat. No. 4,597,554 to James also describes an apparatus consisting of a matched pair of fixture members, one of which must be attached to the picture frame.

U.S. Pat. No. 4,606,626 to Rabinowitz discloses a picture frame hanging apparatus consisting of a single block having hanger projections extending laterally along at least two sides thereof for engagement with the frame to be hung.

U.S. Pat. No. 4,804,161 to Wallo describes an apparatus consisting of a base bar of substantial width having upwardly projecting prongs at opposite ends thereof which are adapted to engage a downwardly facing surface of the top moulding of a frame. The apparatus includes a horizontally elongate fastener hole and a vertically elongate fastener hole for consecutive adjustment of the horizontal and vertical position of the apparatus.

Also known are opposing pairs of roughly triangular devices removably slidable within the side frame channels of a frame. Each of the devices has a hole on one wing thereof permitting connection of a wire between the pair of devices. The wire can then be placed over a nail on a wall or other vertical surface, thereby supporting the frame.

Nevertheless, the frustration of attempting to hang framed artwork with the traditional "hook and wire" method continues to be a nearly universal experience. Even utilizing more than one hook, it is difficult to maintain a frame straight and level using the traditional method. Frames suspended by the standard hook and wire method tend to fall away from the wall at the top, resulting in unattractive gaps between the wall and the top of the frame. Moreover, it is practically impossible to align a series of frames (either vertically or horizontally) using the hook and wire system due to the variations in wire placement, and lengths and flexibility of differing wire types.

SUMMARY OF THE INVENTION (Disclosure of the Invention)

The present invention is of apparatuses for hanging a frame on a surface as well as of methods for hanging frames.

The first apparatus of the invention comprises a body having a front, a back, and a top; a slidable attachment of the body to the top of the frame; and an attachment of the body to the target surface. In the preferred embodiment, the apparatus further comprises a spirit level removeably attached to the body for aligning the body on the surface and the body comprises protruding clip prongs for holding the spirit level. Alternatively, alignment may be performed by at least two alignment notches (preferably V-shaped) disposed on sides of the body, the notches being alignable to a straight line marked on the surface. The removably slidable attachment is preferably a supporting rail disposed on the front of the body which throughout its length protrudes perpendicularly from the front and which has a cross section corresponding to a channel in the frame thereby permitting slidable insertion of the supporting rail in the frame channel. Alternatively, the removably slidable attachment may comprise a recession disposed on the back of the body and a Z-bracket removably and slidably attachable to the frame having a leg corresponding to the recession. The attachment of the body to the target surface preferably comprises at least two openings completely penetrating the body from front to back capable of holding fasteners. Preferably, at least one of the openings is near the center of the body and at least one penetrates the body at an oblique angle. The openings should have a diameter corresponding to the diameter of the fasteners.

The second apparatus of the invention comprises a body having a front, a back, and a tip; and attachment of the body to the frame; at least two alignment notches in the body; and an attachment of the body to the target surface. Preferably, the alignment notches are V-shaped, disposed on sides of the body, and alignable to a straight line marked on the surface.

The first method of the invention comprises the steps of: (a) providing a hanger; (b) placing the hanger flush against a mounting surface; (c) inserting at least one fastener at least partially into the hanger; (d) positioning the hanger at a desired location upon the mounting surface; (e) inserting the first fastener completely through the hanger and into the mounting surface; (f) referring to a spirit level disposed on the hanger; (g) rotating the hanger about the first fastener until the hanger is horizontal according to the spirit level; and (h)

inserting at least one additional fastener through the hanger and into the mounting surface to position and attach the hanger on the surface. The hanger preferably comprises a protruding elongated supporting rail with a shape corresponding to a universal assembly channel of the frame for removable and slidable attachment of the supporting rail within the universal assembly channel. Alternatively, the hanger comprises an elongated recess and a Z-bracket for removable and slidable disposition on the elongated recess.

The second method of the invention comprises the steps of: (a) providing a hanger having alignment notches; (b) marking a mounting surface with a straight guide line; (c) placing the hanger flush against the mounting surface; (d) aligning the alignment notches with the straight guide line; and (e) attaching the hanger to the mounting surface. In the preferred embodiment, the hanger is provided with a V-shaped alignment notches on the sides of the hanger.

The third method of the invention comprises the steps of providing a hanger and slideably attaching the top of the frame to the hanger.

An object of the present invention is to provide a simple, inexpensive means and method for consistently hanging frames straight and level.

Another object of the present invention is to provide an apparatus for hanging frames that is easy to use.

Another object of the present invention is to provide an apparatus for hanging frames that is inexpensively manufactured.

Another object of the present invention is to provide a means and method for consistently hanging frames straight and level that requires no attachments upon the frame.

Another object of the present invention is to provide a means and method for hanging frames that secures the frame flush against the wall or other surface.

It is another object of the present invention to provide a mean and method for hanging multiple frames in horizontal alignment.

Other objects, advantages, and novel features, and further scope of applicability of the present invention will be set forth in part in the detailed description to follow, taken in conjunction with the accompanying drawings, and in part will become apparent to those skilled in the art upon examination of the following, or may be learned by practicing the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principle of the invention. The drawings are only for the purpose of illustrating a preferred embodiment of the invention and are not to be construed as limiting the invention.

DESCRIPTION OF THE PREFERRED EMBODIMENT (Best Mode for Carrying Out the Invention)

The apparatus of the present invention is a simple, one-piece frame positioning bracket for hanging artwork, picture frames or like objects upon a wall or other mounting surface. The apparatus is particularly suited for use with metal picture frames having universal assembly channels, although by utilizing adaptor devices commonly known in the art the apparatus may satisfactorily be practiced with a wide variety of frame types. The design and configuration of the apparatus permit the user consistently to mount frames upon walls in a straight and level manner and flush against the wall. A horizontal rail feature of the apparatus, which accepts a metal frame's universal assembly channel, permits lateral, side-to-side adjustment of a frame once it has been hung. Other elements of the apparatus of the invention permit the user easily to utilize a plurality of the apparatus to hang numbers of frames in horizontal and/or vertical alignment, while assuring that each frame retains its level position upon the wall. The apparatus may be any practicable size; thus, the apparatus may be produced in a variety of sizes.

Reference is made to FIGS. 1–7 which illustrate the preferred apparatus of the invention. The apparatus includes a body 10, made of injection-molded plastic or any other inexpensive, durable material. The material of body 10 preferably is somewhat elastic, such that body 10 generally is quite stiff, but with some resilient flexibility in response it focused loading. Body 10 is substantially planar, with the exception of certain protruding features later described herein.

Figure 1:
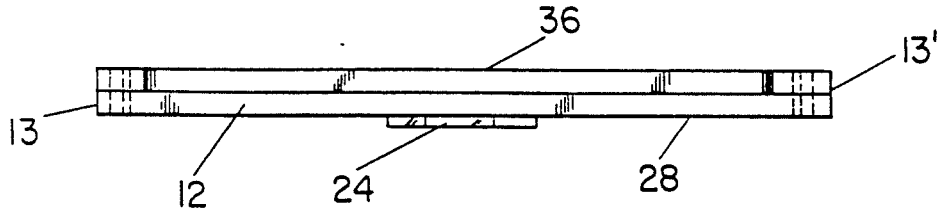
FIG. 1 is a plan view of the top of the preferred embodiment of the apparatus of the invention.
Figure 2:
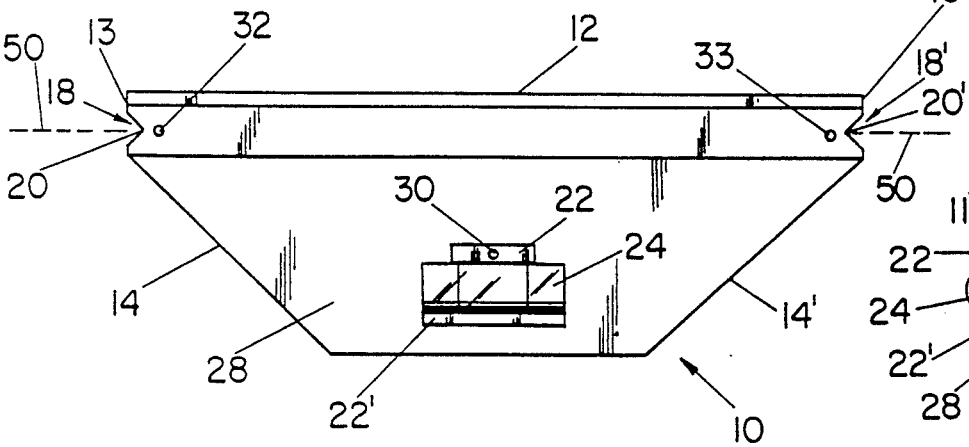
FIG. 2 is a plan view of the front of the FIG. 1 embodiment.
Figure 5:
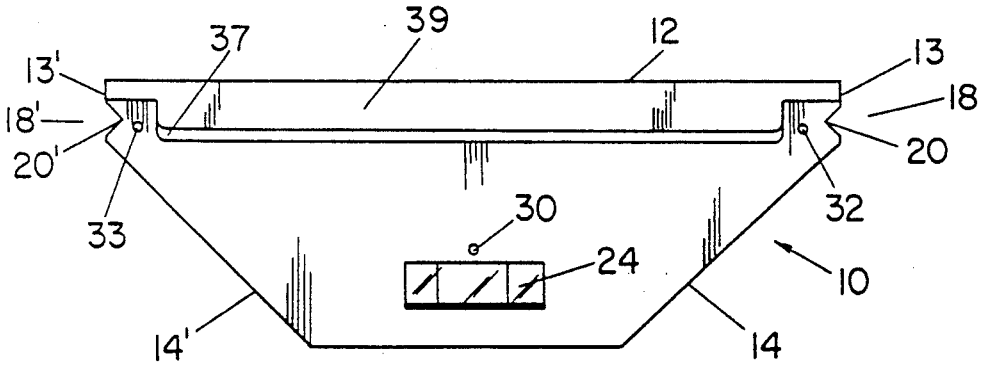
FIG. 5 is a plan view of the back of the FIG. 1 embodiment.

Body 10 preferably is generally trapezoidal in shape when viewed from the front, the longer of the parallel sides of the trapezoid being the top 12 of the apparatus. Other shapes (e.g. rectangular, square, triangular, etc.) may also be used. The trapezoidal section of body 10 is truncated at each location where the non-parallel sides 14,14' otherwise would intersect with the top 12, in order to create short vertical sides 13,13' at right angles with top 12. Alignment notches 18,18' are linear-sided recesses formed into vertical sides 13,13' of body 10. As best illustrated in FIGS. 2 and 5, alignment notches 18,18' are formed in the shape of triangles, with one side of each triangle collinear with one of vertical sides 13,13'. Equilateral triangles are preferred, although isosceles triangles will also suffice (provided the odd sides of isosceles triangles are collinear with corresponding vertical sides 13,13') . Interior vertices 20,20' of alignment notches 18,18' are situated at points equidistant from top 12, so that the line defined by interior vertices 20,20' is parallel to top 12. Importantly, alignment notches 18,18' are situated such that the line defined by their interior vertices 20,20' bisects the interior angles of both alignment notches 18,18'.

Figure 6:
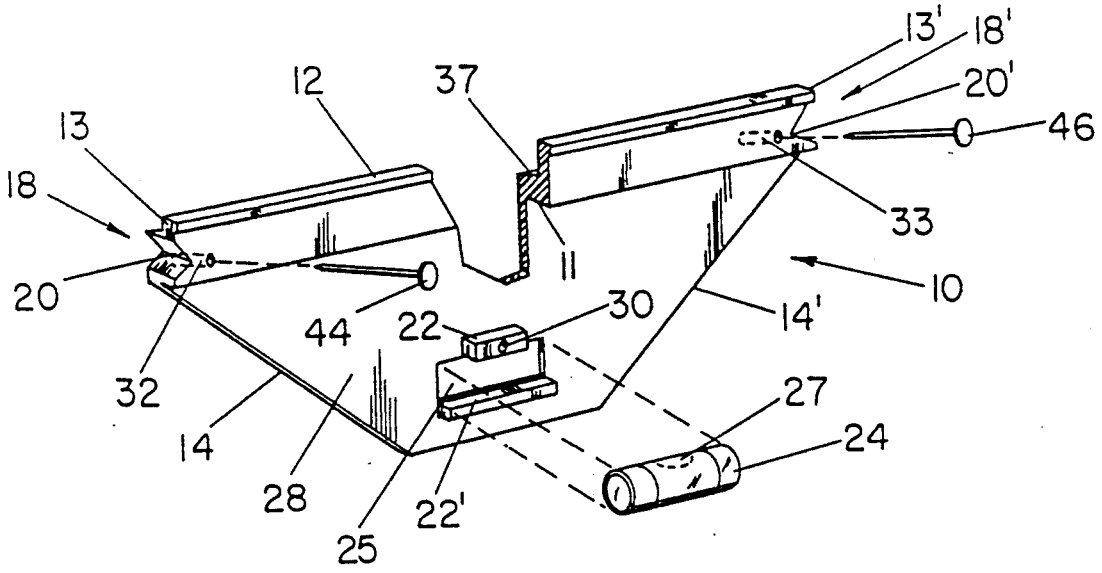
FIG. 6 is a perspective view of the front of the FIG. 1 embodiment with a portion of the apparatus broken away to illustrate a partial cross section of the apparatus.

Best illustrated in FIGS. 2 and 6 are clip prongs 22,22' for grasping spirit level 24. Clip prongs 22,22' protrude from the front 28 of body 10. Throughout this specification, it shall be understood that the front 28 of the apparatus shall be adjacent to and in contact with the item of art to be hung, while back 36 is the face of the apparatus that shall be in direct contact with the wall. Clip prongs 22,22' preferably are an integral part of body 10, that is, they are formed of the same material as body 10 and are an extension thereof. Clip prongs 22,22' may be located nearly anywhere on front 28 of body 10; in the preferred embodiment they are located near and parallel to the bottom 26 of body 10, equidistant from non-parallel sides 14,14'. Importantly, slip prongs 22,22' are parallel to each other and with the top 12 of the apparatus. Clip prongs 22,22' are elongated, preferably slightly hooked protuberances, and are so formed as to exploit the elastic nature of the composition material; their flexibility permits spirit level 24 to be removably inserted between them such that spirit level 24 is securely grasped by clip prongs 22,22' while the apparatus is in use. Likewise, spirit level 24 may be removed from the grasp of clip prongs 22,22' when the apparatus is not in use, with the result that the resiliency of clip prongs 22,22' causes them to spring back to their original configuration.

If necessary to accommodate the reception of spirit level 24 between clip prongs 22,22', body 10 may include spirit level opening 25. Spirit level opening 25 is a rectangular opening through body 10, between clip prongs 22,22', that allows spirit level 24 to be inserted between clip prongs 22,22' and remain in position while the apparatus is in use. Spirit level opening 25 (which alternatively may be a depression (e.g. concave) rather than an opening) provides the necessary clearance to permit a larger spirit level 24 to remain in the apparatus even when front 28 of the apparatus contacts an item of artwork and back 36 is flush against a wall while the apparatus is in use.

Figure 3:
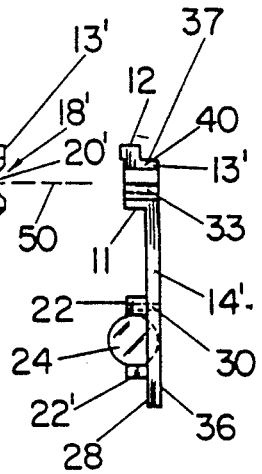
FIG. 3 is a plan view of the side of the FIG. 1 embodiment.
Figure 4:
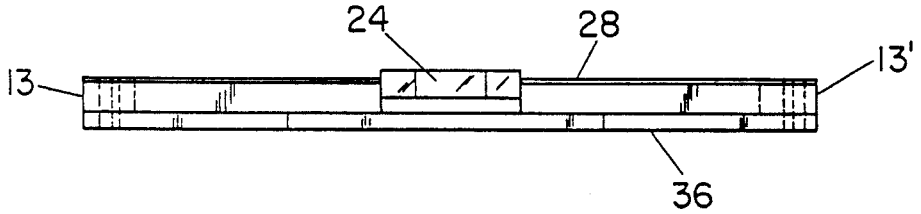
FIG. 4 is a plan view of the bottom of the FIG. 1 embodiment.

As best illustrated in FIG. 3, a portion of body 10 is of additional thickness to form reinforcing rib 11, which runs parallel and adjacent to top 12. Reinforcing rib 11 is observed to be an integral part of body 10 in the shape of a long box extending between vertical sides 13,13'.

Referring to FIGS. 2 and 3, it is seen that extending upwardly and outwardly from reinforcing rib 11 is supporting rail 40, which, like reinforcing rib 11, preferably is an integral part of body 10 and composed of the same material. Supporting rail 40 runs between vertical sides 13,13', adjacent to and along the entire length of top 12. As more particularly illustrated in FIG. 3, supporting rail 40 has a stepped profile, as it extends outward from front 28 a distance approximating the depth of a corresponding frame, and also upward a small distance from top 12. As best shown in FIG. 6, supporting rail 40 and reinforcing rib 11 together present a particular uniform cross section throughout their common length. This unique cross section is so designed as to permit the apparatus of the invention specially to interlock with the frame to be hung.

As shown in FIGS. 2 and 6, the uppermost of the two clip prongs 22,22', which preferably is an integral portion of body 10, has additional thickness for purposes of strengthening the apparatus and accommodating a specialized mounting hole 30 as shall hereinafter be described. It observed, therefore, that excepting clip prongs 22,22' and supporting rail 40, which protrude from the face of front 28, front 28 preferably is smooth and flat.

Brief reference is made to FIGS. 1, 5, 7, and 8, showing back 36 of body 10. Back 36 is substantially smooth and flat, which characteristic permits the apparatus to be mounted flush against a wall or other flat mounting media. The semi-flexible character of body 10 also permits the satisfactory mounting of the apparatus to walls or other media having a slight curvature or minute surface irregularities. As shown in FIGS. 1, 5, 7, and 8, back 36 of the preferred embodiment of the apparatus has rear ledge 37, which is a horizontal surface parallel to the plane of top 12 resulting from the abrupt narrowing in the thickness of body 10 along top 12. This narrowed thickness in body 10 is manifested in the form of a bracket recess 39 also running the width of top 12 at a depth equivalent to the depth of rear ledge 37. Rear ledge 37 runs the entirety, or nearly the entirety, of the width of top 12; it may be modified as needed to accommodate the location of side mounting holes 32 and 33, as illustrated in FIG. 5.

FIGS. 2, 5, 6, 7, and 8 show central mounting hole 30, and side mounting holes 32 and 33. Central mounting hole 30 and side mounting holes 32 and 33 are small-diameter holes drilled or otherwise formed as to completely penetrate through body 10 from front 28 to back 36. Central mounting hole 30 is situated equidistant from non-parallel sides 14,14' at the center of the uppermost of the two clip prongs 22,22'. The uppermost clip prong 22, preferably is of greater mass than lower clip prong 22, so as to be reinforced to accommodate central mounting hole 30. Side mounting holes 32 and 33 each penetrate reinforcing rib 11 near the ends of top 12, a short distance from the respective interior vertices of alignment notches 18,18'.

Specific reference is made to FIG. 3. It is noted that side mounting holes 32 and 33 penetrate body 10 at oblique angles downward from front 28 to back 36, such that the openings of the holes on front 28 are somewhat closer to top 12 than the corresponding openings on back 36. Central mounting hole 30 penetrates body 10 at an angle normal to front 28 and back 36. The diameters of central mounting hole 30 and side mounting holes 32 and 33 are preferably approximately equal to, or slightly less than, the diameter of the fasteners with which the apparatus will be hung and the holes are preferably tapered to hold the nail firmly during mounting. Preferably, the diameters of the mounting holes 30, 32, 33 are just slightly less than the diameters of the fasteners to be used, so that a slight amount of force may be required to insert the fasteners into the mounting holes 30, 32, 33. These features of the apparatus allows the three mounting holes 30, 32, 33 to serve as "nail keepers" which grasp and hold the nails or screws while the user hammers or turns the fasteners into the wall. In the preferred embodiment, the fasteners to be used are nails. Alternatively, screws may be used to hang the apparatus. An advantage of the invention is, therefore, that it is easily practiced by a single user; the apparatus' three mounting holes 30, 32, 33 hold the fasteners, thus freeing one of the user's hands to operate a hammer or screwdriver while the other hand holds the apparatus 10 in place.

Figure 7:
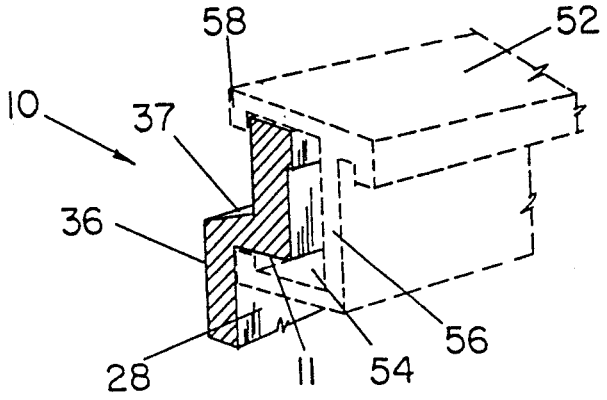
FIG. 7 is a perspective view of the FIG. 1 embodiment shown mounted in a typical metal frame channel.

The preferred method of practicing the invention is best understood with reference to FIGS. 6 and 7. Spirit level 24 is snapped into position between clip prongs 22, 22' on the front 28 of the apparatus 10 and into spirit level opening 25 as needed. The apparatus 10 is then placed against the wall or other mounting medium, and held by hand at the desired mounting location. Top 12 of the apparatus is positioned approximately horizontal on the wall and slightly below the desired location of the top of the frame to be hung. The user then manually inserts nails 44,46 (only two shown) or other suitable fasteners into central mounting hole 30 and side mounting holes 32 and 33. The "nail keeper" advantage of the invention comes into play as the snug fit between the fasteners and the mounting holes 30, 32, 33 causes the fasteners to remain within the mounting holes 30, 32, 33, in ready position to be hammered or screwed, while the user's hands are freed to position the apparatus 10 and wield tools.

Using spirit level 24, the user adjusts and manipulates the apparatus 10 until it is in a level position on the wall as shown by the level 24. It is easily observed that when the bubble 27 in spirit level 24 gives visual indication that spirit level 24 is level, the entire apparatus 10 likewise will be level, with both top 12 and supporting rail 40 in horizontal position (and presumably parallel to the floor and ceiling).

Holding the apparatus 10 thus positioned with one hand, with the other hand the user hammers the nail (not shown) disposed within central mounting hole 30 through central mounting hole 30 and into the wall. The nail is not hammered completely into the wall; a small length of nail is left exposed between the apparatus and the head of the nail so that the apparatus remains free to rotate about the nail. This continued freedom of rotation about the central fastener allows the user to perform any further required positional adjustments to restore and maintain the apparatus' horizontal disposition.

Having constant reference to spirit level 24, the user maintains the apparatus in a level position while a side nail 44 (or alternatively 46), held by either of the two side mounting holes 32 (or alternatively 33), is hammered through the side hole 32 and into the wall. This side nail 44 through side mounting hole 32 is hammered "home" i.e. until the head of the side nail 44 is snug against the front 28 of the apparatus and the apparatus is securely held thereby. During the hammering of this first side nail 44, the user exercises care to maintain the horizontal position of the apparatus; in the event the apparatus is mispositioned, the first side nail 44 is withdrawn, the apparatus is readjusted, and hammering is recommenced.

Once the first side nail 44 or 46 is hammered into position, the unhammered second side nail 46 (or alternatively 44) in the other side mounting hole 33 (or alternatively 32) is also hammered home. The user will no longer need manually to hold the apparatus in place, as it is secured by the nail through the central mounting hole and by the first side nail 44. Because the latter two fasteners are already secured within the wall, the level position of the apparatus is fixed, and not easily disturbed during the hammering of the second side nail 46. Finally, the nail through central mounting hole 30 is hammered completely home until its head is firmly against the front 28 of the apparatus. It thus is noted that the triangular arrangement of the mounting holes and fasteners, and the sequential securing of the fasteners as described, permits the user easily to attach the apparatus to the wall in a level position through constant reference to spirit level 24.

While the preferred embodiment of the apparatus contemplates the use of three fasteners, it will be apparent to one skilled in the art and having reference to the above disclosure that any number of fasteners greater than one will suffice. Specifically, it is noted that two fasteners, with corresponding mounting holes, would permit the invention adequately to be practiced; additional numbers of fasteners provided added security.

If desired, spirit level 24 may then be removed from the apparatus and reused in another apparatus of the invention. Alternatively, spirit level may remain in the apparatus, where it will be covered by the artwork and thus be invisible to observers.

Thus secured to the wall, the apparatus is ready to accept a frame for hanging. Further explanation of the hanging method shall follow hereinafter.

An alternative method of practicing the invention is particularly well suited to hanging multiple frames in a horizontal line of display. Using a tape measure or spirit level and a carpenter's chalk line, or other conventional means, the user of the invention causes a thin (approximately 1 mm) horizontal line (shown in FIG. 2 as a dashed line 50) to be temporarily marked upon the wall or other mounting media. Such a line 50 should be sufficiently long to accommodate the desired number of frames at the desired horizontal spacing. The height of the line 50 above the floor should be somewhat less (typically approximately 5 cm to 15 cm, depending on the size of the frames) than the desired distance from the floor to the tops of the frames.

Reference is made to FIGS. 2 and 6. With the temporary horizontal line 50 on the wall serving as a guide, alignment notches 18,18' are used in lieu of a spirit level to assure the horizontal positioning of the apparatus. The user first inserts the desired fasteners into central mounting hole 30 and side mounting holes 32 and 33, as in the preferred methodology described above. The user then places the apparatus 10 against the wall so that both interior vertices 20,20' of alignment notches 18,18' are located precisely upon the horizontal wall line 50, i.e., such that the horizontal wall line 50 bisects exactly the interior angles of alignment notches 18,18'. The fasteners, preferably nails, are then hammered into the wall in the same order and manner as described in the preferred methodology, except that the user has constant reference to the horizontal wall line 50, instead of a spirit level, in order to maintain the level position of the apparatus 10 during hanging. Assuming that the horizontal wall line 50 is truly level, placing the interior vertices 20,20' of alignment notches 18,18' upon that line 50 will assure the horizontal position of the apparatus 10 and its supporting rail 40. Visible portions of the horizontal wall line 50 may be erased after the artwork(s) are hung in final position.

It here is noted that the methodology described immediately above may have application to objects, other than frames, to be attached to a surface. The method may be practiced with nearly any device upon which another item will be attached. Likewise, the surface need not be a wall, but can be any surface to which a frame or other device needs to be attached.

In all embodiments and methodologies, the order of certain of the method steps may be varied without adversely affecting the practice of the invention. The fasteners may be inserted in the mounting holes either before or after the apparatus is placed against the wall; the fasteners may be inserted either before or after the apparatus is leveled; the order in which the fastening nails are hammered home may be varied; and the like.

The method claims are thus not limited to the order of steps set forth therein.

Reference is new made to FIG. 7. Metal artwork frames 52 commonly used in the art are typically fashioned from lengths of molded or extruded aluminum or other inexpensive material. These sections of material normally are molded or extruded to include, as an integral part of the frame, universal assembly channels 54—recesses within the four sections of the frame, used to accommodate the right-angle brackets used to attach the sections together. The uniform assembly channel 54 has a uniform angular C-shaped cross section 56, runs the entire length along the interior of the frame's sides, top and bottom, and permits the installation of right-angle brackets within the channels at the frame's interior corners. The open portion of the C-shaped cross section 56 opens outwardly to the rear of the frame (e.g. toward the wall). Accordingly, the universal assembly channel 54 is hidden against the wall when the picture is hung. The uppermost section of the universal assembly channel 54, as it runs along the inside of the top section of the frame, serves as a lip or rib 58 which may be received onto a customized hook attached to a wall. It is an object of the present invention to provide just such a customized hook.

Once the apparatus is securely attached to the wall or other mounting medium, a picture frame is easily hung thereon using supporting rail 40. As may be noted from FIGS. 3, 6, and 7 when the apparatus properly has been installed on the wall, supporting rail 40 extends outward and upward, i.e. away from the wall. It thus effectively serves as a continuous hook running the width of the apparatus, upon which the picture frame may be hung. The simplicity of the invention is exploited by lifting the framed art to the apparatus, and manipulating the frame until the entire length of supporting rail 40 is inserted into the universal assembly channel 54 within the top section of the frame. While hanging the frame upon the apparatus, it may be necessary to tip the frame slightly, the top section closer to the wall, in order to facilitate the entry of supporting rail 40 into the universal assembly channel 54. Once supporting rail 40 has been hooked into the universal assembly channel 54, the frame is then gently rested against the wall and left to hang upon the apparatus 10. The uppermost portion of the universal assembly channel 54 (having, as it does, a C-shaped cross-section 56) provides not only a horizontal surface which rests upon the top of supporting rail 40 and thus supports the frame, but also a vertical, downwardly projecting surface that is situated between supporting rail 40 and the wall. Supporting rail 40 and the universal assembly channel thus interlock as complimentary hooks. When properly engaged, therefore, the length of supporting rail 40 fills some or nearly all the void of the universal assembly channel 54, and prevents the frame from being pulled away from the wall without first being lifted up and over supporting rail 40. As can be seen, no hanging wires, hooks, or other devices are required to be attached to the frame; the attached apparatus 10 of the invention, by fitting into the universal assembly channel 54 provides both wall attachments and frame attachments. The horizontal position of the frame may easily be adjusted merely by sliding the frame back and forth upon supporting rail 40, which is free to slide within the universal assembly channel.

Figure 8:
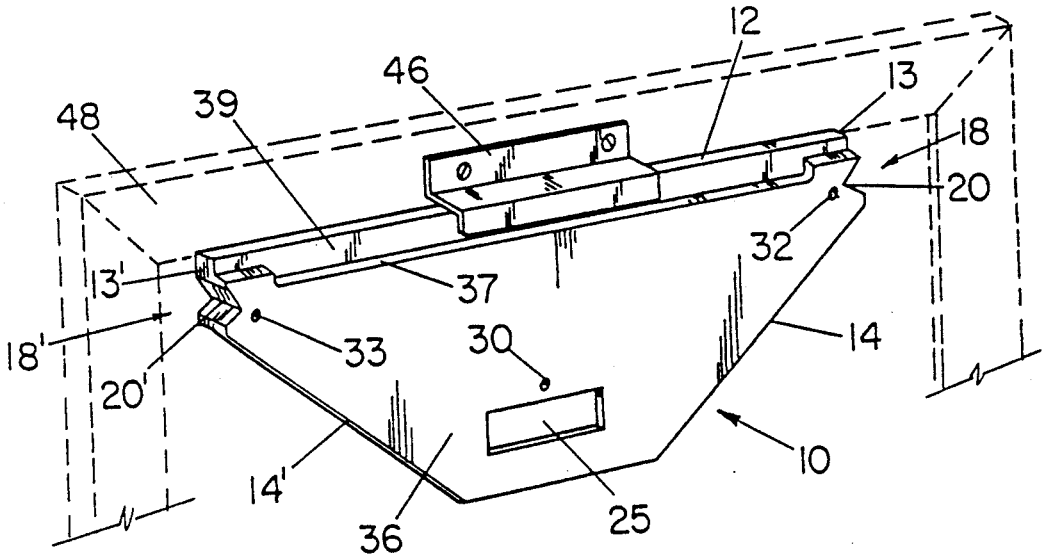
FIG. 8 is a perspective view of the back of the FIG. 1 embodiment, illustrating an alternative application and companion apparatus.

Alternatively, the invention may satisfactorily be practiced with frames lacking universal assembly channels. FIG. 8 depicts the usage of a commonly available Z-bracket 46 to permit the invention to be applied to wooden frames, or any alternative frame otherwise lacking universal assembly channels. Z-bracket 46 is securely attached to the center of the back of the top section of alternative frame 48. Using screws, brads or adhesives, one leg of Z-bracket 46 is horizontally affixed to the top section of alternative frame 48, aligned with the top thereof, while the other-free leg protrudes outward and downward away from the frame 48.

When practiced with frames lacking universal assembly channels, the apparatus 10 is attached to the wall using either of the processes described above, i.e. level attachment using spirit level 24 or horizontal wall line 50. When attached flush against the wall, the apparatus 10 will nevertheless comprise a void or pocket between top 12 of body 10 and the wall, as a result of the presence of bracket recess 39 as depicted in FIG. 8.

With continued reference to FIG. 8, it is seen that alternative frame 48 may be hung upon the apparatus by gently placing the free leg of Z-bracket 46 into the void of bracket recess 39, between body 10 and the wall, until Z-bracket rests upon rear ledge 37. The frame's horizontal position may by further adjusted by sliding Z-bracket back and forth within bracket recess 39 and upon rear ledge 37.

The apparatuses, and methods for their use, permit a user to quickly, easily, and consistently hang frames horizontally and flush against a wall. Openings in the body grasp nails or other fasteners and hold them in ready position for hammering or screwing, freeing the user's hands to position the apparatus and securely attach it to the vertical mounting surface.

Although the invention has been described with reference to these preferred embodiments, other embodiments can achieve the same results. Variations and modifications of the present invention will be obvious to those skilled in the art and it is intended to cover in the appended claims all such modifications and equivalents. The entire disclosures of all applications, patents, and publications cited above, and of the corresponding application are hereby incorporated by reference.

What is claimed is:

1. An apparatus for hanging on a surface a frame assembled from members having a universal assembly channel defined by a generally C-shaped cross section which opens outwardly to the rear of the frame, said apparatus comprising:

a body having a front, a back, sides and a top;

an elongated planar supporting member disposed on said front of said body;

means for removeably slidably attaching said elongated planar supporting surface within the universal assembly channel of the frame;

means for aligning said body on the surface;

means for providing attachment of said body to the surface;

wherein said body alignment means comprises at least two horizontally disposed alignment notches; and said alignment notches are disposed on said sides of said body.

2. An apparatus in accordance with claim 1, wherein said body alignment means comprises a spirit level.

3. An apparatus in accordance with claim 2, wherein said spirit level is removably attachable to said body.

4. An apparatus in accordance with claim 2, wherein said body further comprises spirit level holding means.

5. An apparatus in accordance with claim 4, wherein said spirit level holding means comprises protruding clip prongs.

6. An apparatus in accordance with claim 5, wherein said alignment notches are alignable to a straight line marked on the surface.

7. An apparatus in accordance with claim 5, wherein said alignment notches comprise V-shaped depressions on said sides of said body.

8. An apparatus in accordance with claim 1 wherein said elongated planar supporting member comprises a supporting rail disposed on said front of said body.

9. An apparatus in accordance with claim 8, wherein said supporting rail throughout its length protrudes perpendicularly from said front of said body.

10. An apparatus in accordance with claim 9, wherein said supporting rail comprises a cross section corresponding to the universal assembly channel in the frame thereby permitting slidable insertion of said supporting rail in the universal assembly channel.

11. An apparatus in accordance with claim 1, wherein said means for providing attachment of said body to the surface comprises at least two openings completely penetrating said body from said front to said back for holding fasteners.

12. An apparatus in accordance with claim 11, wherein at least one of said openings is located near the center of said body.

13. An apparatus in accordance with claim 11, wherein at least one of said openings penetrates said body at an oblique angle.

14. An apparatus in accordance with claim 11, wherein said openings comprise tapered predetermined diameters corresponding to diameters of said fasteners.

15. A method of hanging frames, the method comprising the steps of:

a) providing a hanger apparatus with a centrally disposed fastener opening and at least two additional fastener openings disposed to the sides and above the centrally disposed fastener opening;

b) placing the hanger apparatus flush against a mounting surface;

c) inserting a first fastener at least partially into the centrally disposed opening in the hanger apparatus;

d) positioning the hanger apparatus at a desired location upon the mounting surface;

e) inserting the first fastener completely through the centrally disposed opening in the hanger apparatus and into the mounting surface;

f) referring to a spirit level horizontally disposed on the hanger apparatus;

g) rotating the hanger apparatus about the first fastener until the apparatus is horizontal according to the spirit level; and h) inserting at least two additional fasteners through the additional fastener openings in the hanger apparatus and into the mounting surface to position and attach the hanger apparatus on the surface.

16. The method of claim 15, wherein the step of providing a hanger apparatus comprising an elongated planar support surface comprises providing a hanger apparatus comprising a protruding elongated supporting rail with a shape corresponding to a universal assembly channel of the frame for removable and slidable attachment of the supporting rail within the universal assembly channel.

17. The method of claim 15, wherein the step of providing a hanger apparatus comprising an elongated planar support surface comprises providing a hanger apparatus with an elongated recess and a Z-bracket for removable and slidable disposition on the elongated recess.

18. A method for hanging frames assembled from members having a universal assembly channel defined by a generally C-shaped cross-section which opens outwardly to the rear of the frame, comprising the steps of:

a) providing a hanger apparatus comprising an elongated planar supporting member; and b) slideably attaching the top of the frame to the hanger apparatus; and c) wherein the step of providing a hanger apparatus further comprises providing a hanger apparatus comprising a protruding elongated supporting rail with a shape corresponding to the universal assembly channel of the frame for removable and slideable attachment of the supporting rail within the universal assembly channel.

* * * * *